US006677512B1

(12) United States Patent
Chen

(10) Patent No.: US 6,677,512 B1
(45) Date of Patent: Jan. 13, 2004

(54) PROTECTION DEVICE OF A BATTER HEAD

(76) Inventor: Michael Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/437,011

(22) Filed: May 14, 2003

(51) Int. Cl.[7] ..... G10D 13/02
(52) U.S. Cl. ..... 84/411 R
(58) Field of Search ..... 84/411 R, 416, 84/418, 421, 411 A

(56) References Cited

U.S. PATENT DOCUMENTS 5,892,169 A * 4/1999 Shapiro ..... 84/411 M
6,031,169 A * 2/2000 Coppola ..... 84/411 R
6,166,311 A * 12/2000 Barrickman ..... 84/411 R
6,576,829 B1 * 6/2003 Hart ..... 84/737

* cited by examiner

*Primary Examiner*—Kimberly Lockett
(74) *Attorney, Agent, or Firm*—Leong C. Lei

(57) ABSTRACT

A protection device of a batter head is disclosed. The device is characterized in that the hoop face of the counterhoop is spaced with a plurality of engaging disc with elastic hook, one-end of the engaging disc is provided with protruded ratchet teeth, a securing ring is locked to the front face of the batter head, and the rim face of the securing rim corresponding to the engaging disc is provided with a protruded inclined ratchet gear face to gradually lodge the batter head against the ratchet gear face on the engaging disc gradually.

3 Claims, 6 Drawing Sheets

PROTECTION DEVICE OF A BATTER HEAD

BACKGROUND OF THE INVENTION (a) Technical Field of the Invention

The present invention relates to batter head, and in particular, to a protection device which in combination with a counterhoop and an engaging disc, the batter head of a drum is locked and secured.

(b) Description of the Prior Art

Conventionally, the batter head thickness is about 0.1–0.3 mm. In order to provide ideal drum acoustic, in particular, during live performances, the interior of the drum is mounted with sound effect devices or microphone. When these components are provided, the batter head is designed with a hollow hole so that the components can be inserted therein, as shown in FIGS. 5, 6A and 6B. The batter head 30 is designed with a through hole 31, facilitating connection from the external to the interior of the drum body. Due to the fact that the thickness of the batter head 30 is extremely thin, in the course of forming a circular hole the edge of the hole is as sharp as a blade which can be easily tom due to strong vibration of the drum. To avoid this, the edge of the through hole 31 has to be covered to avoid accidental cutting. The conventional protection device for the through hole 31 is a securing hoop 32 with an L-shaped cross-section and the bottom face of the inner edge is disposed with a dual-layered adhesive tape 33, such that when the tape 33 is inserted into the through hole 31, the tape 33 is adhered to the surface of the batter head 30. The other internal face of the batter head 30 is mounted with a concentric securing rim 34 with similar diameter. The connection face is also mounted with an adhesive tape 33 so as to adhere onto the inner face of the batter head 30 and the through hole 31 is protected.

However, the effectiveness of protection of the batter head is solely dependent on the adhesive tape 33. After a period of use, the adhesion ability of the adhesive tape is lost and the effectiveness of protection is poor. Accordingly it is an object of the present invention to provide a protection device of a batter head which mitigates the above drawback.

SUMMARY OF THE INVENTION

Accordingly, it is an object of the present invention to provide a batter head protection device having a batter head structure including a batter head combined with an edge, and a counterhoop disposed on the batter head for the locking on the through-hole edge, and securing elements, characterized in that the hoop face of the counterhoop is spaced with a plurality of engaging disc with elastic hook, one end of the engaging disc is provided with protruded ratchet teeth, a securing ring is locked to the front face of the batter head, and the rim face of the securing rim corresponding to the engaging disc is provided with a protruded inclined ratchet gear face to gradually lodge the batter head against the ratchet gear face on the engaging disc gradually.

Yet another object of the present invention is to provide a protection device of a batter head, wherein the elastic engaging disc of the counterhoop is separated from the rim body by having an opened slot at the two lateral sides.

Still a further object of the present invention is to provide a protection device of a batter head, wherein the rim face of the securing rim at the gap between the spaced ratchet teeth face, appropriate height securing block is provided, facilitating tightening by rotation from the external using a tool.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
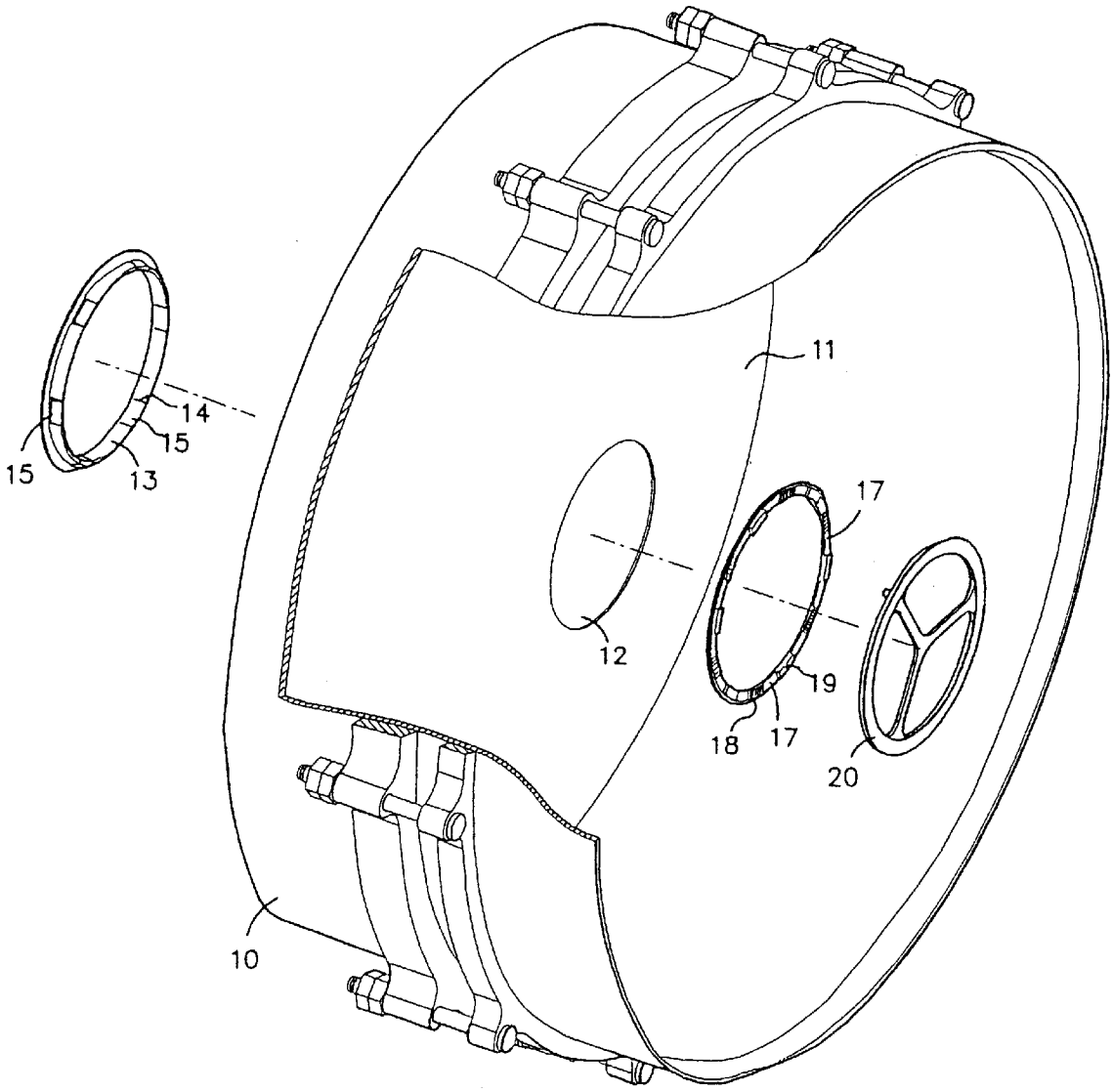
FIG. 1 is a perspective exploded view of a through hole counterhoop of a batter head of the present invention.
Figure 2:
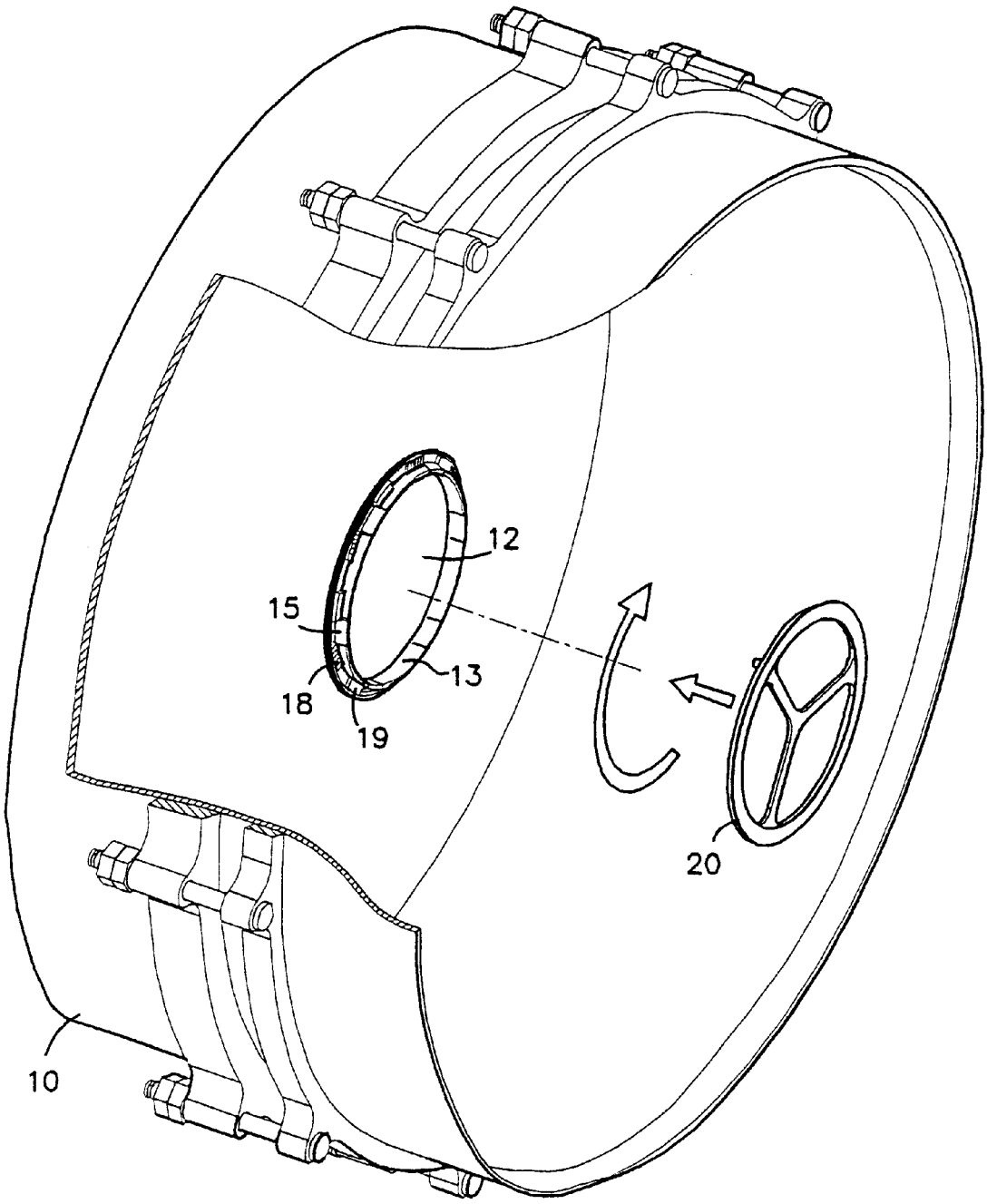
FIG. 2 is a perspective view of a counterhoop of a batter head in accordance with the present invention.
Figure 3B:
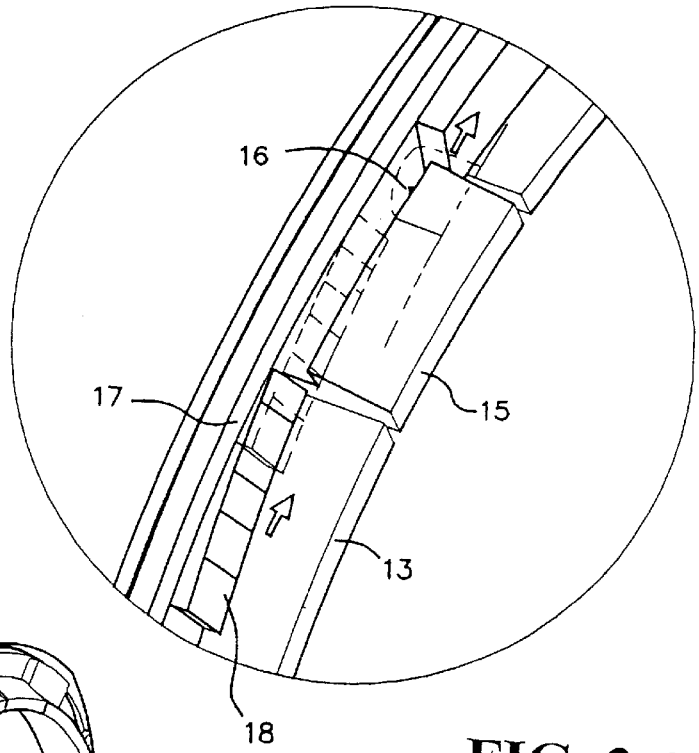
FIG 3B is an enlarged view of a portion of FIG. 3A.
Figure 3A:
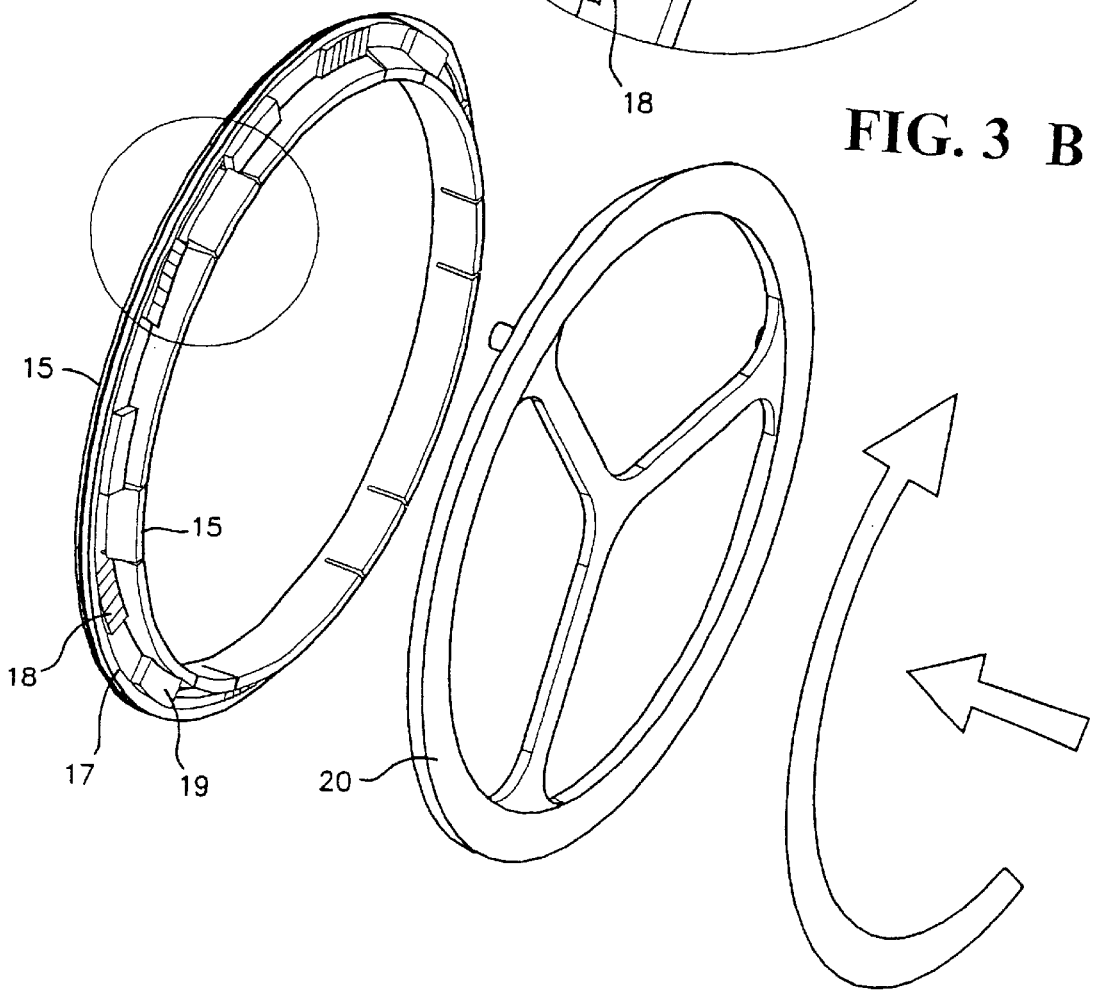
FIG. 3A is a schematic view showing the locking of the counterhoop and the securing rim in accordance with the present invention.
Figure 4B:
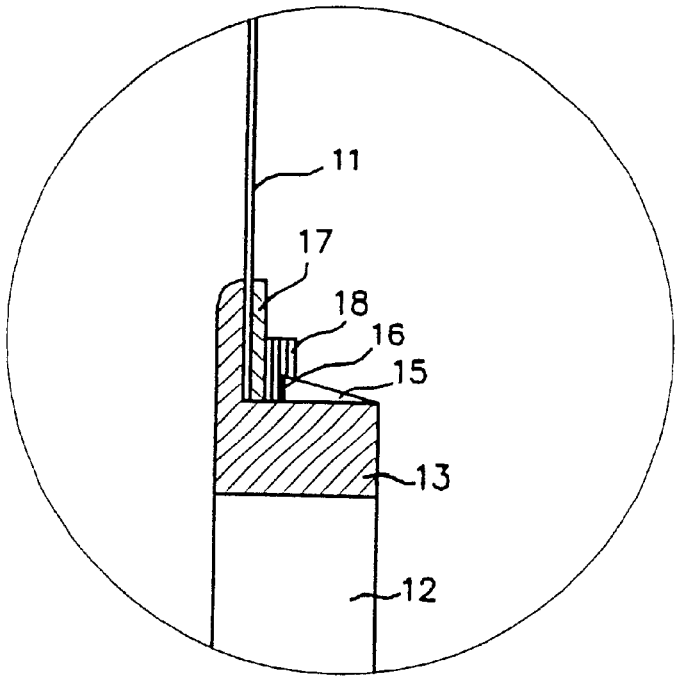
FIG 4B is an enlarged view of a portion of FIG. 4A.
Figure 4A:
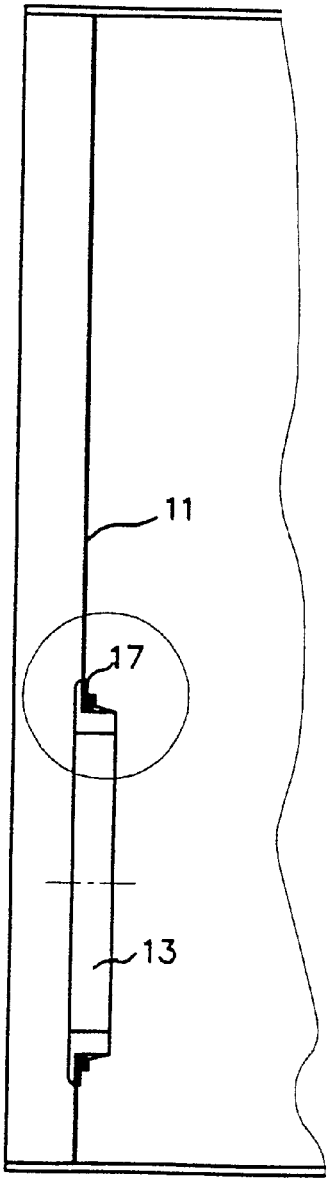
FIG. 4A is a plan view of a through hole counterhoop of a batter head in accordance with the present invention.
Figure 5:
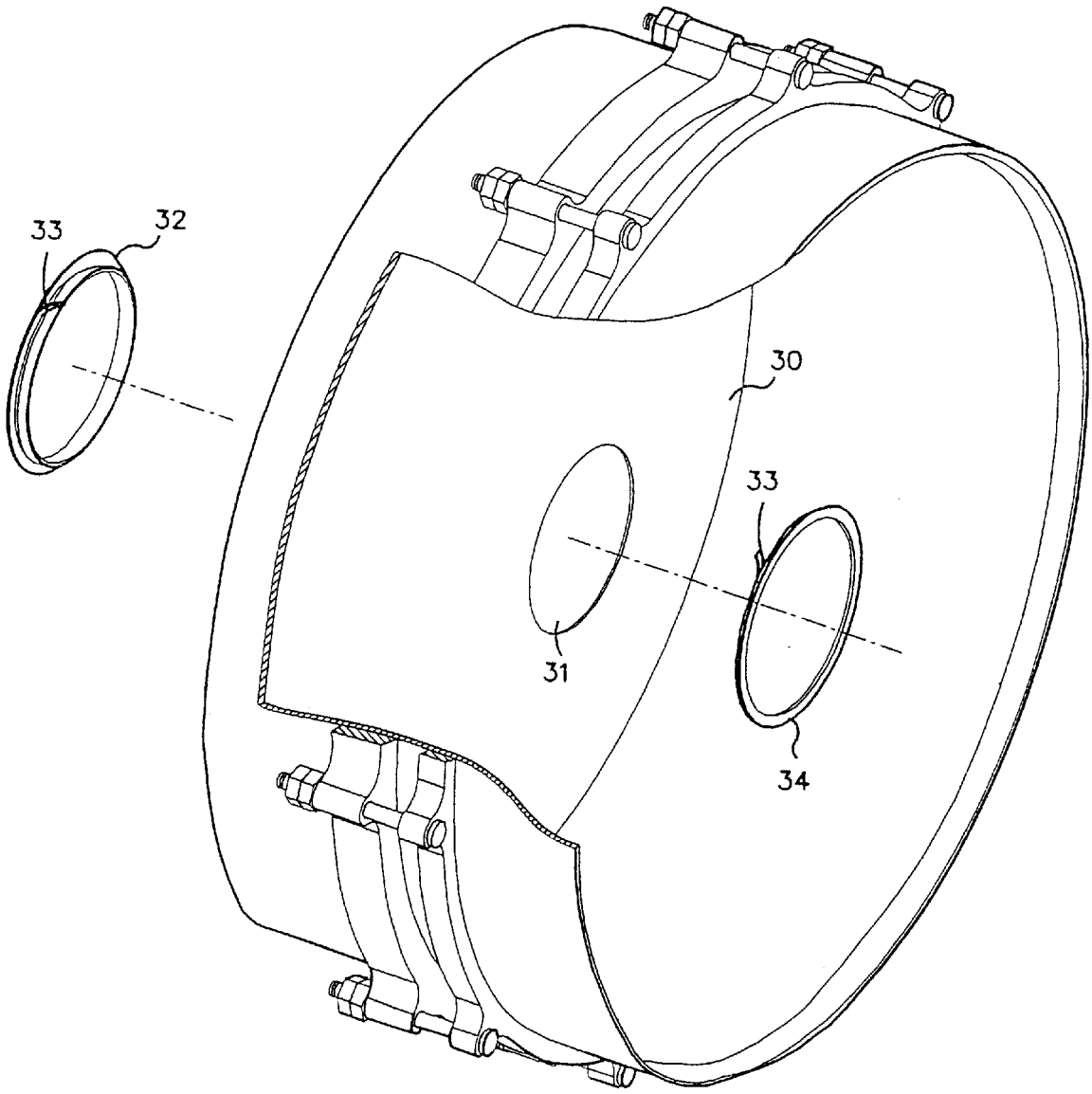
PRIOR ART FIG. 5
FIG. 5 is a perspective exploded view of a conventional through hole counterhoop of a batter head.
Figure 6B:
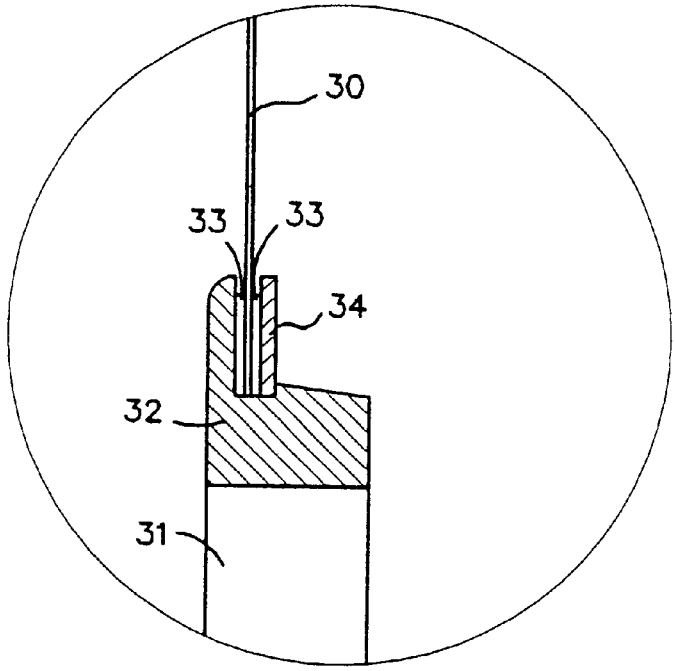
PRIOR ART FIG. 6 B
FIG. 6B is an enlarged view of a portion of FIG. 6A.
Figure 6A:
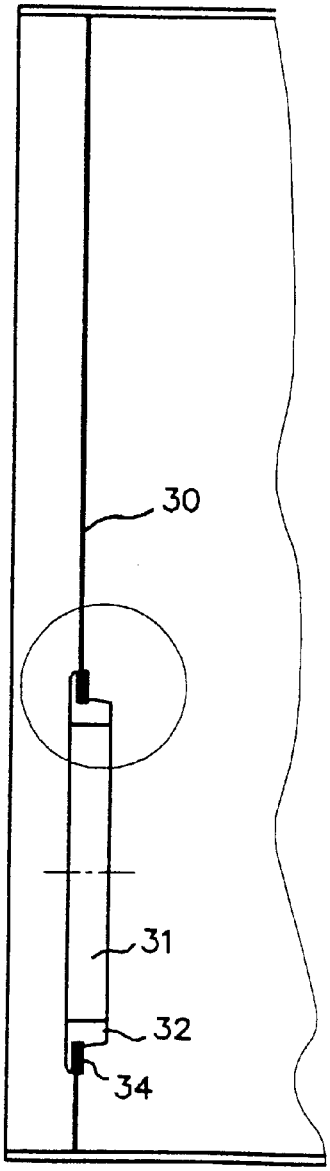
PRIOR ART FIG. 6 A
FIG. 6A is a plan view of a conventional through hole edge counterhoop.

Referring to FIGS. 1, 2, 3A, 3B, 4A and 4B, there is shown a protection device of a batter head, on one side of the drum body 10, the batter head 11 is generally provided with a through hole 12, in general, the rim radius is about 15 cm, facilitating hand to pass through. The edge of the through hole 12 is provided with a plastic securing counterhoop 13 having a substantially L-shaped cross-section. There are opened slots 14 at the two lateral sides on the rim face of the counterhoop 13 and spaced apart elastic engaging disc 15. One end of the engaging disc is protruded with ratchet teeth 16. In assembly, the counterhoop 13 is inserted from the front face of the batter head 11, and the inner side of the batter head 11 is locked with a securing rim 17. The rim face of the securing rim 17, corresponding to the engaging disc 15, is provided with protruded, inclined ratchet gear face 18.

Together with the positioning block 19, a tool rim 20 is used to rotate to fastening. The ratchet gear face 18 is designed based on the thickness of the batter head 11. In combination with the ratchet teeth 16 on the engaging disc 15, the counterhoop 13 is gradually tightened. Therefore, the safety counterhoop 13 is exactly mounted to the edge of the through hole 12 of the batter head.

In accordance with the present invention, the counterhoop 13 can be used in batter head 11 of various thicknesses. The inclined ratchet gear face 18 allows gradual fastening of the counterhoop 13. This will assure the counterhoop 13 has locked to the edge of the hole provided on the batter head 11, and the protection function of the counterhoop 13 is achieved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A batter head protection device having a batter head structure including a batter head combined with an edge, and a counterhoop disposed on the batter head for the locking on the through-hole edge, and securing elements, characterized in that the hoop face of the counterhoop is spaced with a plurality of engaging disc with elastic hook, one end of the engaging disc is provided with protruded ratchet teeth, a securing ring is locked to the front face of the batter head, and the rim face of the securing rim corresponding to the engaging disc is provided with a protruded inclined ratchet gear face to gradually lodge the batter head against the ratchet gear face on the engaging disc gradually.

2. The batter head protection device of claim 1, wherein the elastic engaging disc of the counterhoop is separated from the rim body by having an opened slot at the two lateral sides.

3. The batter head protection device of claim 1, wherein the rim face of the securing rim at the gap between the spaced ratchet teeth face, appropriate height securing block is provided, facilitating tightening by rotation from the external using a tool.

* * * * *